United States Patent [19]

Workum

[11] Patent Number: 4,673,110

[45] Date of Patent: Jun. 16, 1987

[54] SPRAY-DISCHARGE DEVICE FOR A DEFORMABLE CONTAINER

[76] Inventor: Donald Workum, 10 Boulevard Saint Ruf, 84000 Avignon, France

[21] Appl. No.: 616,942

[22] Filed: Jun. 4, 1984

[30] Foreign Application Priority Data

Jun. 14, 1983 [ES] Spain ..... 272902

[51] Int. Cl.[4] ..... B65D 25/40; B05B 1/34

[52] U.S. Cl. ..... 222/211; 222/213; 222/493; 222/495; 239/493

[58] Field of Search ..... 222/211, 213, 493, 495, 222/212, 215, 491, 206, 389, 402.17, 390, 522, 525, 492; 239/464, 490, 493

[56] References Cited

U.S. PATENT DOCUMENTS

| | | | |
|---|---|---|---|
| 2,353,355 | 7/1944 | Okies | 222/390 |
| 3,401,845 | 9/1968 | Bach | 222/213 |
| 3,493,179 | 2/1970 | Lee | 222/211 |
| 3,963,150 | 6/1976 | Steiman et al. | 222/211 |
| 4,020,979 | 5/1977 | Shay et al. | 222/211 |
| 4,437,582 | 3/1984 | Dörner | 222/495 |
| 4,463,878 | 8/1984 | Crone | 222/206 |

FOREIGN PATENT DOCUMENTS

| | | | |
|---|---|---|---|
| 1164124 | 10/1958 | France . | |
| 1485415 | 7/1966 | France . | |
| 1485417 | 7/1966 | France . | |
| 2292526 | 6/1976 | France . | |
| 2341369 | 9/1977 | France . | |
| 2364168 | 4/1978 | France | 222/495 |

*Primary Examiner*—H. Grant Skaggs
*Assistant Examiner*—Nils E. Pedersen
*Attorney, Agent, or Firm*—Schwartz, Jeffery, Schwaab, Mack, Blumenthal & Evans

[57] ABSTRACT

A deformable spray dispenser comprises a valve unit which is capable of axial displacement within the container with respect to the container cover between a spray-discharge position and an air-suction position. The valve unit supports a member for shutting-off the eductor tube in its air-suction position. The valve unit is provided with a valve cap having an external face which is applied against an internal face of the container cover in the spray-discharge position and cooperates with the internal face so as to form a nozzle for discharging liquid through the container-cover orifice in an atomized spray pattern.

17 Claims, 8 Drawing Figures

SPRAY-DISCHARGE DEVICE FOR A DEFORMABLE CONTAINER

The present invention relates to a spray-discharge device for a deformable container of the type employed in a number of industries including household cleaning products and toilet products. By means of this device, expendable liquids are dispersed in a fine spray from a container made of material which is sufficiently flexible to be deformable by hand. Containers of this type can thus be compressed by the user in order to produce a pressure for the purpose of discharging their liquid contents through an eductor tube which extends to the bottom of the container and in order to be subsequently re-inflated under elastic action while producing a partial vacuum which has the effect of sucking-in air from the exterior of the container.

The invention relates more specifically to devices of this type which comprise a single orifice extending through a rigid cover which closes the container. Said orifice serves both to expel liquid to be sprayed and to suck-in air from the exterior.

The essential aim of the invention is to improve the operation of the spray-discharge device in its different stages while at the same time permitting manufacture at low cost. Compared with known devices of the prior art, the spray-dispensing device in accordance with the invention in fact has the main advantages of ensuring a high quality of atomization dispersion, of preventing any disturbances arising from changes in level of liquid as the container is being emptied during use, of ensuring a rapid entry of external air from the outside into the container after a spraying operation, and generally of increasing the possibility and efficiency of repeated spraying operations within very short periods of time.

To this end, the spray-discharge device in accordance with the invention essentially comprises a valve unit which is capable of moving axially within the container between a spray-discharge position and an air-suction position with respect to a rigid cover which closes the container and is provided with the orifice for discharge of liquid and suction of air. Said valve unit is adapted to support a member for shutting-off the eductor tube in its air suction position and is provided with a valve cap having a wide external face which is adapted to cooperate with an internal face of the container cover in the spray-discharge position in order to form a nozzle for discharging liquid through said orifice in an atomized spray pattern.

In a preferred embodiment, the eductor tube closure member is formed in one piece with the valve cap and is constituted by an axial stem which may be tubular and penetrates into a cup forming a connection between the eductor tube and the valve until it comes into leak-tight contact with said cup in the air-suction position.

In another embodiment, the valve unit is constructed in the form of two components fitted one within the other for displacement in relative sliding motion between two end positions. One component is adapted to carry the valve cap which defines the nozzle in the spray-discharge position. The other component is adapted to carry the eductor tube closure member. This design concept makes it possible to obtain a prompt moving effect on the closure member when leaving the closing position to to the spray-discharge position.

It is an advantage to provide the valve unit both at the top end corresponding to the container cover and at the bottom end corresponding to the eductor tube with large surfaces which can be subjected in alternate sequence either to the pressure required for upward displacement of the valve unit in the spray-discharge position or to the effects of the partial vacuum produced within the container when this latter is no longer compressed. This is the most significant function performed by the valve cap in producing a rapid movement of the valve unit when said valve cap is located between the orifice of the container cover and the opening which establishes a communication between the device and the interior of the container. Guiding of the valve unit with respect to the fixed components of the device, in particular with respect to the cover which closes the container, is preferably arranged in such a manner as to ensure that air is readily and freely admitted into the container during the suction stage.

It will be noted that the orifice formed through the container cover can be as large as requirements may dictate in order to permit easy penetration of air sucked-in from the exterior. This does not interfere with operation in the spray-discharge nozzle condition since in this case the cross-sectional area for flow of liquid is determined by the opposite faces of the valve unit and of the container cover in the vicinity of the same orifice. Preferably, these faces are flat at this point and ducts arranged in a radiating pattern with respect to the orifice of the container cover are provided in either or both of the faces aforesaid. If so required, said ducts may open tangentially into said orifice in order to form a vortical-flow nozzle.

The spray-discharge device in accordance with the invention can be adapted to a number of different modes of spray dispersion according to the direction of the spray jet. While retaining the essential advantages achieved by the invention, it is thus possible to form either a vertical spray jet in the axis of the container or a horizontal jet or even an oblique jet. In a vertical jet design, the valve unit can be simply guided in its displacements with respect to the container cover by means of wings slidably mounted on a cylindrical internal face of the container cover, a space of appreciable width being provided between said guide wings in order to permit a return of air by suction after spraying. In the case of a horizontal or oblique jet, provision can usefully be made in addition for a predetermined orientation of the valve unit within the container cover by subjecting the valve unit to a displacement in longitudinal sliding motion, for example by means of wings slidably engaged in grooves of the container cover.

Other features of the invention will be more apparent to those skilled in the art upon consideration of the following description and accompanying drawings, wherein.

Figure 1:
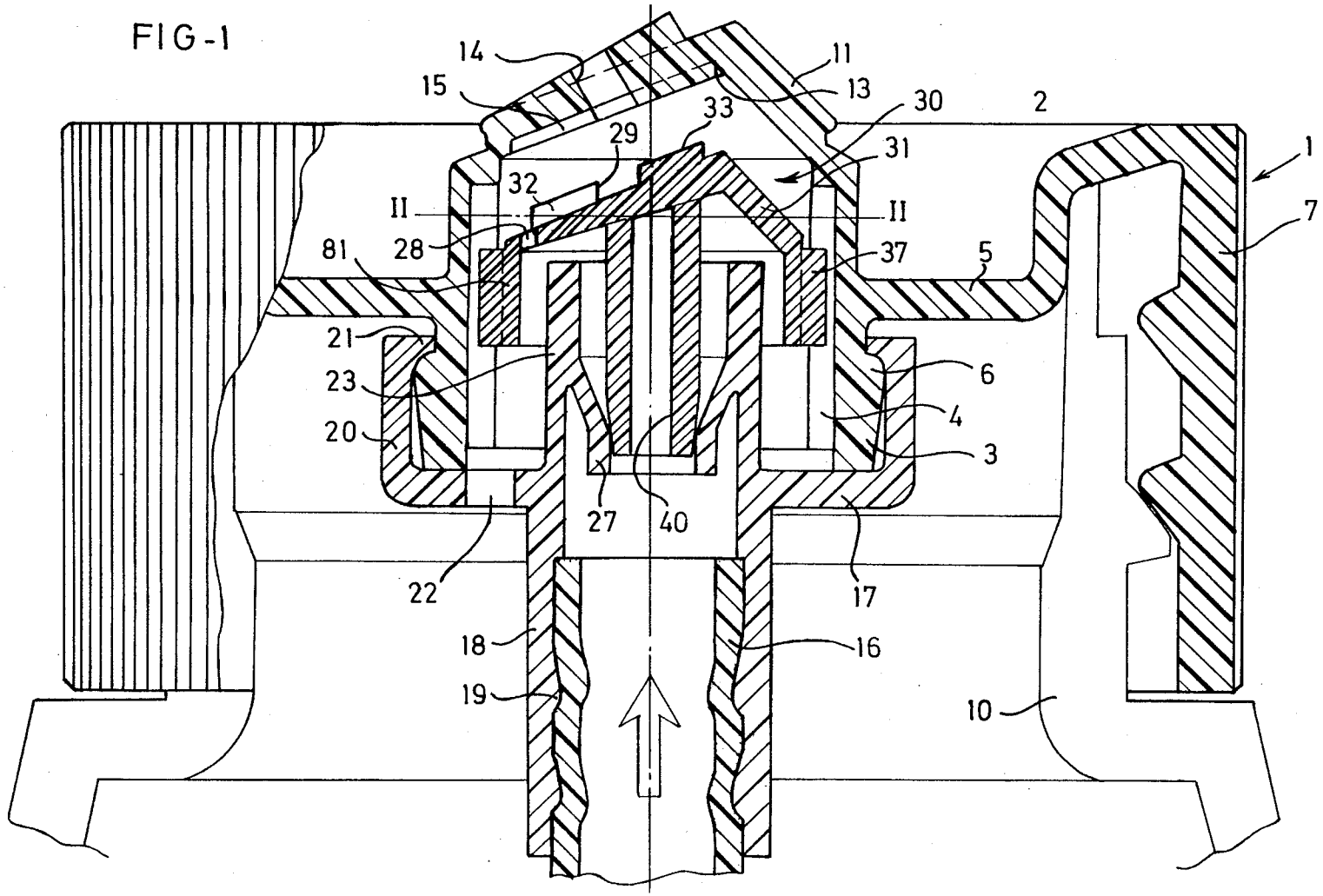
FIG. 1 is an axial sectional view in elevation showing a first embodiment of a spray-discharge device in accordance with the invention.

The spray-discharge device of FIG. 1 as generally designated by the reference numeral 1 essentially comprises a valve unit 30 which is displaceably mounted within a spray-discharge valve body comprising a cover 2 which serves to close the container 10. Said cover is provided internally with a cylindrical skirt 3. Axial grooves 4 which, in the embodiment shown, are two in number and located in diametrically opposite relation are cut in the internal wall of said skirt 3. The container cover is provided with an annular bulge 6 formed on the external wall of the skirt 3 within the interior of the container. The surfaces of said annular bulge have an inclination such as to permit the coupling function to which further reference will be made hereinafter. An annular trough 5 joins the inner skirt 3 to an outer skirt 7 which serves to fix the cover by screwing or snap-action engagement on the neck of the container 10, only a top fragment of which is shown in the figure.

Figure 7:
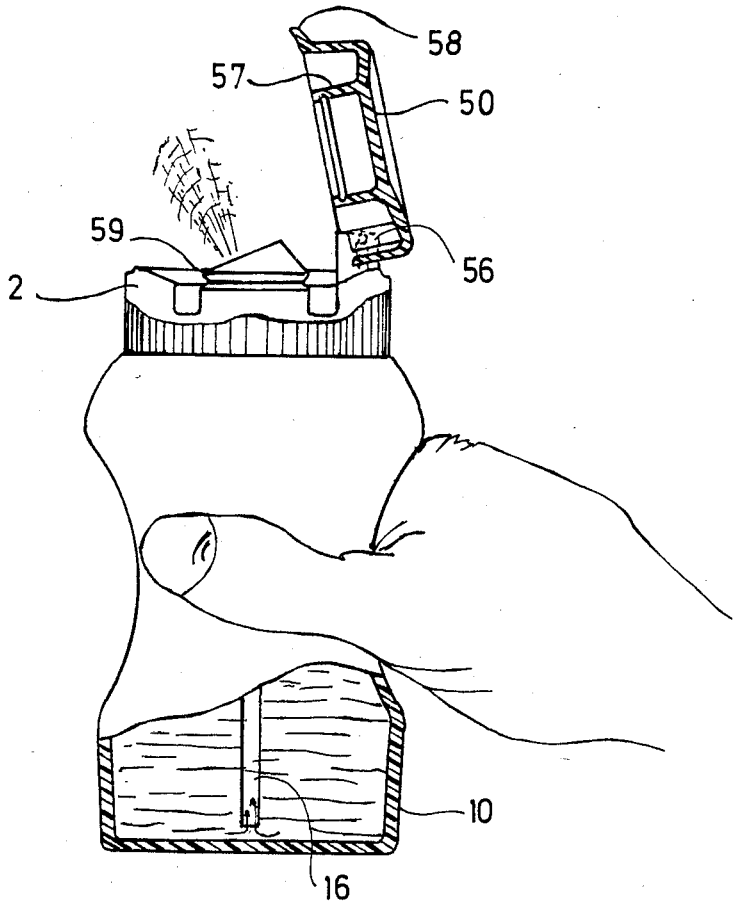
FIG. 7 is a general view of a container equipped with the spray-discharge device in accordance with the invention and shows in cross-section a hinged cap for protecting said device.

However, the container 10 is illustrated in FIG. 7 and it is apparent from this figure that said container is formed of flexible plastic material which makes it deformable by the user's hand and is ready to revert to its initial shape after elastic stress. In accordance with customary practice, compression of the container by the user initiates spray-discharge operation whereas a return to the normal position has the effect of drawing external air into the container.

Figure 2:
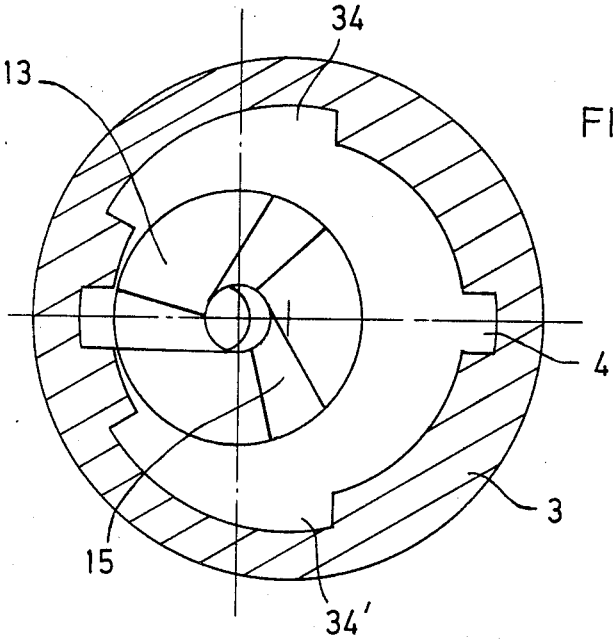
FIG. 2 is a bottom sectional view taken along the line II—II of FIG. 1 and relates to the same embodiment but shows the central portion of the cover which serves to close the device.

The upper portion 11 of the container cover 2 which closes the central portion above the internal cylindrical skirt 3 is constituted by a wall whose internal face forms at least one flat bearing surface 13. As shown in FIGS. 1 and 2, the flat bearing surface 13 is arranged obliquely with respect to the axis of the container cover 2 and is of circular shape. An orifice 14 is pierced through the wall of the container cover at the center of the flat portion 13 in an orientation which is also oblique. In the embodiment shown, the bearing surface 13 is provided with grooves which form ducts 15 in a radiating arrangement and open tangentially into the orifice 14. Preferably, the grooves are uniformly spaced and are three in number. This design concept corresponds to that of a so-called vortex nozzle.

Through the bottom portion of the skirt 3, the container cover 2 communicates with the eductor tube 16, the lower end of which has its opening near the bottom of the container 10. Preferably, this communication between the eductor tube 16 and the container cover 2 is established by means of a connecting member consisting of a cup 17, a lower tubular extension 18 of which is provided with annular channels and beads 19 which are capable of engaging the external surface of the eductor tube so as to ensure an air-tight assembly. However, it is also possible to employ any other mode of connection such as snap-action engagement or the like.

The cup 17 forms an annular recess surrounded by an outer skirt 20 and by an inner skirt 23, this inner skirt being located in the line of extension of the lower tubular portion 18. The outer skirt 20 is provided at its upper end with an internal projection 21 which ensures a practically leak-tight coupling with the annular bulge 6 of the cylindrical skirt 3 of the container cover 2. The bottom of the cup 17 is pierced by one or a number of orifices 22 which are usually three in number and allow air to flow in each direction between the air-filled headspace located above the liquid in the container and the internal portion of the spray-discharge valve, namely the portion delimited by the cup 17 and the central top portion of the container cover 2. Said internal portion also communicates with the eductor tube 16 through the interior of the cylindrical skirt 23 at the level of a valve seat formed by an internal lip 27 of said skirt. The valve unit 30 is adapted to cooperate with said valve seat in order to cut-off the communication between the interior of the spray-discharge valve body and the eductor tube when said valve unit is in the position corresponding to the air suction stage after a spray-discharge operation.

The obturator 30 is capable of displacement within the spray-discharge valve body between two end-positions: the bottom position corresponds to the air intake stage and the top position corresponds to the spray-discharge stage. Said valve unit has an axial stem 40 above which is mounted an obturator 31. The axial stem 40 is hollow in the particular case which is illustrated. Said stem constitutes the eductor tube closure member and has a frusto-conical end section which is adapted to its function of accurate leak-tight contact with the lip 27. The obturator 31 forms an internal annular cavity which has a bottom opening and into which penetrates the skirt 23 of the cup 17 but without any contact between their respective walls. This arrangement permits efficient guiding of the liquid which is discharged from the eductor tube when the valve unit is displaced in the upward direction for a spraying operation. Orifices 28 are provided inside an annular part 81 of the cap surrounding skirt 23.

Figure 3:
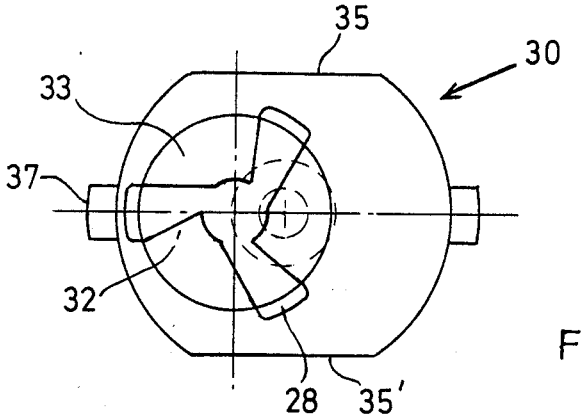
FIG. 3 is a top view of the valve unit which is assumed to be separate from the other components of the device.

The spray-discharge position is not shown in FIG. 1. However, the complementary shapes of the outer (upper) face of the obturator 31 and of the inner (lower) face of the central portion 11 of the container cover are clearly apparent in this figure and will now be described, not only with reference to this figure but also with reference to the complementary FIGS. 2 and 3.

The outer face of the valve cap is provided with a flat bearing surface 33 having a circular contour which, in the spray-discharge position, is applied against the flat bearing surface 13 of the container cover which has already been described. In the case of an oblique spray jet, these bearing surfaces are also oblique and displaced off-center with respect to the axis of the device. It has already been mentioned that grooves 15 are cut in the bearing surface 13 in a radiating pattern which is tangential with respect to the orifice 14, thus permitting operation of a vortical-flow nozzle in the spray-discharge stage. In a comparable manner, grooves 32 are cut in the bearing surface 33 of the valve unit. Provision is made for three grooves corresponding to the grooves 15. This number of grooves is to be adopted in the majority of instances but is not given in any limiting sense. Bearing surfaces 13 and 33 have corresponding shapes to come in tight contact.

The grooves 32 open into a common recess 29 which is placed opposite to the spray-discharge orifice 14. At their radially opposite ends, said grooves have their openings at the level of orifices 28 pierced through the wall of the valve cap inside annular part 81. These orifices allow air to flow between the top face and the underneath face of cap 31, but their primary function is to permit the flow of liquid in the spray-discharge stage. When the valve unit has reached the top end-of-travel position in which it is applied against the internal face of the cover, the respective grooves 15 and 32 cooperate so as to form ducts which are the only passageways for the flow of liquid propelled through orifices 28 and conveyed through these ducts to the discharge orifice 14. The vortical flow nozzle is thus formed.

By virtue of this arrangement, the cross-sectional area for the spray being formed is defined by said ducts, and not by the section of orifice 14. The liquid is mixed with air issuing from the interior of the container via orifices 22, which produces a venturi-tube effect. The air and liquid rates in the spray are determined independently. The liquid part depends on the size of orifices 28 and on how much the eductor tube valve opens. The air stream depends on the size of orifices 22, inasmuch as the valve unit is dimensioned so that no restriction to the air flow occurs around it. The air stream which is mixed with the liquid as it enters the ducts of the nozzle makes it break into fine drops, thus forming the spray inside the ducts before it is propelled outside the device.

Regarding the discharge orifice, it is to be noted that said orifice is freely determined so as to permit the most efficient admission of air when the container is restored to its initial shape as a result of elasticity after a spraying operation. It will further be noted that the obturator 31 represents a large surface area which is responsive to the effects both of the discharge pressure and of the suction pressure.

It is important to give due consideration to the fact that the particular design concept of the nozzle formed by the cooperating faces of the valve unit and of the container cover in the vicinity of the orifice 14 makes this nozzle radically different from a simple restriction of the cross-sectional area of the orifice 14 by means of a cone-point which penetrates into this latter. However, the special shape which has been described is not intended to imply any limitation. In particular, the ducts conveying the liquid/air mixture could be formed only on the valve cap or else only on the internal face of the container cover.

In the case of an oblique-jet nozzle as described in the foregoing, the obturator 30 is secured against rotation in its longitudinal displacements with respect to the container cover 2. To this end, the valve cap 31 is provided externally with two wings 37 located in diametrically opposite positions and slidably mounted in the longitudinal grooves 4 of the internal skirt of the container cover. It is apparent from FIG. 2 that, in addition to said grooves 4, the skirt 3 of the container cover forms wide recesses 34 and 34' which leave free spaces at these locations between the valve unit and the container cover whereas the cross-section of part 81 is provided with flat portions 35 and 35' which increase the space even further. This design facilitates the circulation of the air stream which passes through the orifices 14 and 22, mainly by flowing around the valve unit and additionally through the orifices 28 in the suction phase.

Figure 4:
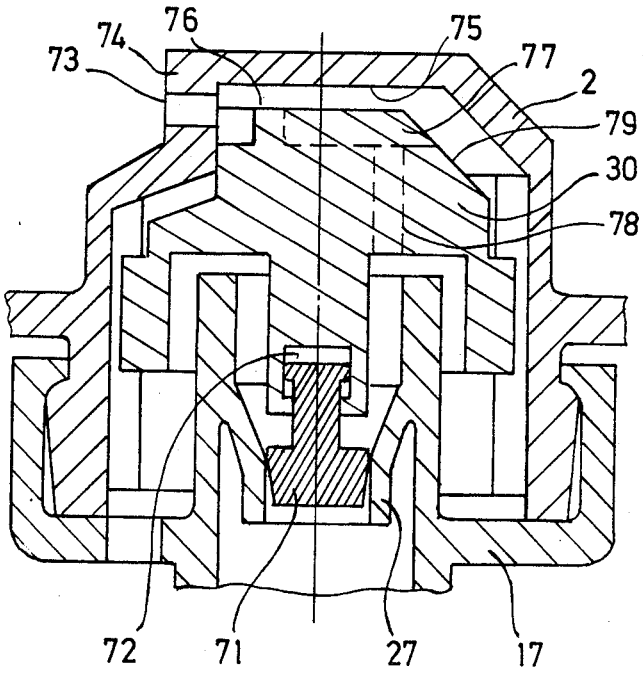
FIG. 4 is an axial sectional view of the central portion of the device in an embodiment which constitutes a variant of the device shown in FIG. 1 and is intended to produce a horizontal spray jet.

In the embodiment of FIG. 4, there are again shown the essential elements which have already been described and which essentially consist of the container cover 2, only the central portion of which is illustrated, the cup 17, only the top portion of which is visible in the figure, and the obturator 30. In this case, the valve unit 30 is constructed in two parts and comprises a valve 71, the lower portion of which constitutes the eductor tube closure member which cooperates with the lip 27 of the valve unit. The upper portion of said valve is contained within a cavity 72 of the other part of the valve unit. The connection provided at this level permits displacement in longitudinal sliding motion between two end-of-travel positions which are such as to ensure that, in the first place, said closure member is not liable to be hindered as it comes into contact with the lip 27 and that, in the second place, there is no potential danger of interference between the cooperating faces forming the spray-discharge nozzle as they are applied against each other. The displacements of the piston 71 with respect to the other part of the obturator 30 improve the operation of the device due to a sudden tearing away effect on the piston at the instant the latter leaves the position where it closes the eductor tube.

The design of the upper portion of the valve unit which forms the valve cap in particular is distinguished from the arrangement of FIG. 1 in the fact that the container cover, the valve unit and the nozzle formed by these latter are so designed as to discharge a spray-jet which is horizontal or in other words perpendicular to the axis of the device. It is thus apparent that the discharge orifice 73 is pierced through a vertical wall 74 of the container cover. The valve unit is capable of sliding against said vertical wall by means of a flat vertical face. The flat bearing surfaces of the container cover and of the valve unit which are applied against each other in the spray-discharge position are shown respectively at 75 and 76. The nozzle passages or ducts are formed by grooves 77 solely in the valve unit. Only two such grooves are provided and extend together opposite to the discharge orifice 73. The opposite ends of said grooves terminate at the ends of two ducts 78 which communicate with the space formed beneath the valve cap. More grooves can of course be provided, but all of them opposite to the discharge orifice 73.

Figure 5:
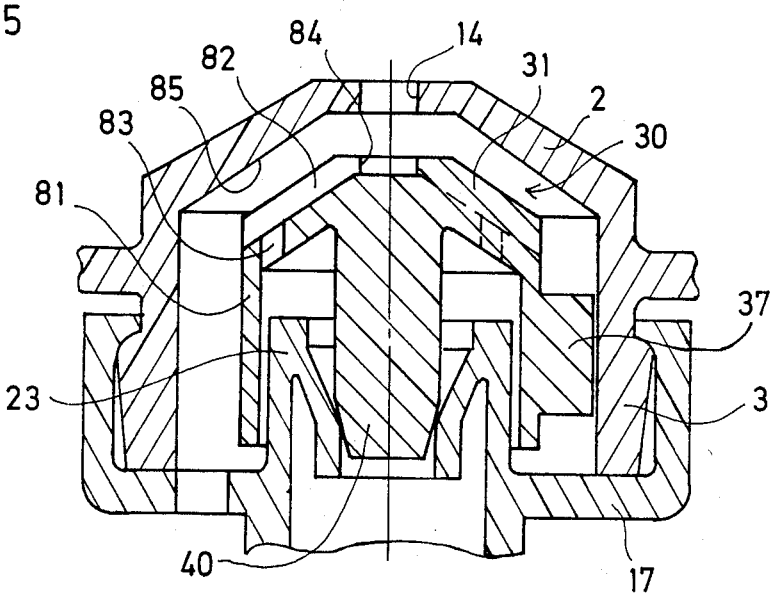
FIG. 5 is a similar sectional view in another alternative embodiment which is suited to the discharge of a vertical spray jet.

The embodiment of FIG. 5 is also very similar to the embodiment of FIG. 1 but is adapted in this case to produce a vertical spray jet in the axis of the container and of the spray-discharge device. There are therefore again shown in this figure the container cover 2, the cup 17 and the obturator 30 with its cap 31 having a downward extension in the form of a longitudinal annular portion 81 which carries the guide wings 37. But all these components are endowed with symmetry of revolution since the discharge orifice 14 cover is located in the axis of the container. In the particular case which is illustrated, the nozzle comprises three ducts formed against the underface 85 of the container cover 2, which is smooth, by means of three grooves 82 cut in the top face of the obturator 31 so as to convey the spray with the liquid admitted through peripheral orifices 83 up to the axial recess 84 in a vortical flow pattern. In consequence, it has not been considered useful to provide guide grooves within the cylindrical skirt 3 of the container cover since the wings 37 have a centering effect without any special orientation.

Moreover, it has been assumed that the valve stem 40 is solid and that a relatively small clearance is allowed between the central duct 23 of the cup 17 and the annular portion 81 of the valve cap which surrounds said duct. Thus the separation provided between the air and liquid circuits is even more complete than in the alternative embodiments described earlier.

Figure 6:
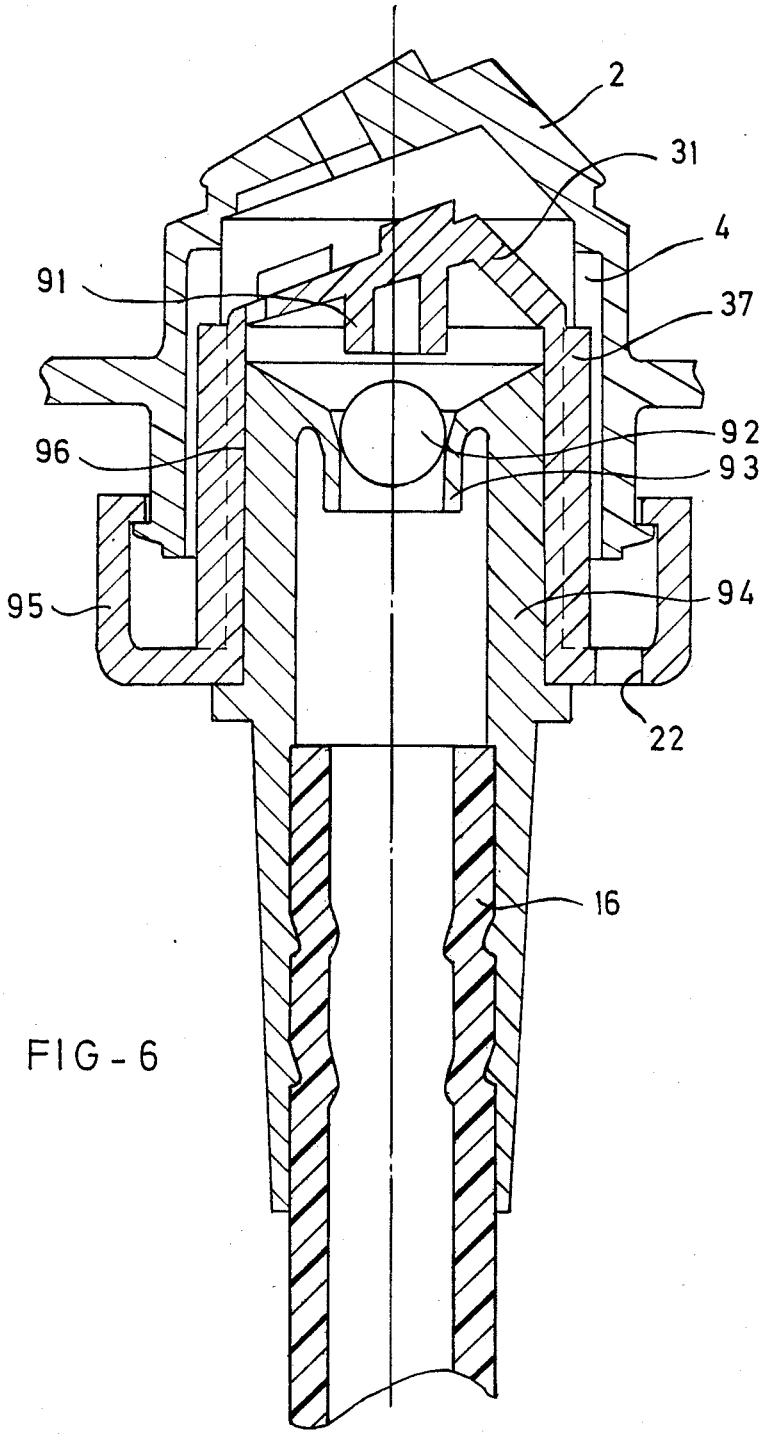
FIG. 6 is yet another view in a similar cross-section and showing a fourth embodiment.

The difference between the embodiment of FIG. 6 and the embodiments described thus far lies in the fact that the two functions of the valve unit are assigned to two separate and distinct elements. The design of the spray-discharge nozzle portion is strictly in accordance with the embodiment of FIG. 1. The same applies to the design of the valve cap 31 together with its guide wings 37 which are slidably engaged in grooves 4 of the container cover 2. On the other hand, the axial stem 91 which is rigidly fixed to the obturator 31 does not directly perform the function of a closure member for preventing communication with the eductor tube 16. This function is performed by a valve ball 92.

The ball 92 is capable of displacement between a top position in which it is thrust upward under the pressure of liquid and retained by the stem 91 and a bottom position in which it is applied against a valve seat as a result of the partial vacuum produced after a spray discharge. Said valve seat is formed by a lip 93 located within a tube 94 which is mounted on the upper end of the eductor tube.

Another difference which is apparent from this figure lies in the fact that the cup of the previous figures is replaced by the housing 94 and a cup-shaped annular member 95 which is formed in one piece with the cylindrical extension 96 of the obturator 31. Said cup-shaped annular member which is provided with the air-intake orifices 22 is therefore intended to move with the valve unit and the same applies to the tube 94 which is fixed within said valve unit and replaces the central duct of the cup shown in FIG. 1. At the same time, the liquid expulsion and air suction circuits are completely separate on each side of the cylindrical extension 96 although they are combined within the upper portion of the device above the valve cap 31.

Among other points noted in the foregoing description, it will have become apparent that the valve unit of the device in accordance with the invention always combines the function of opening and closing the inlets for admission of liquid with the function which consists alternately in forming the spray-discharge nozzle and in releasing the air-admission inlet. Furthermore, it can be understood from the description of specific embodiments, that the shape of the valve cap, when curved and hollow underneath, is efficient to lead the liquid to the nozzle, while the circuit for the return of external air after each spraying operation is separate since it is located essentially outside the valve unit. Referring specifically to the embodiment of FIG. 4, it will be noted that the rear face 79 and the lateral faces are cut away from the cover, to permit the flow of air in the suction stage.

Figure 8:
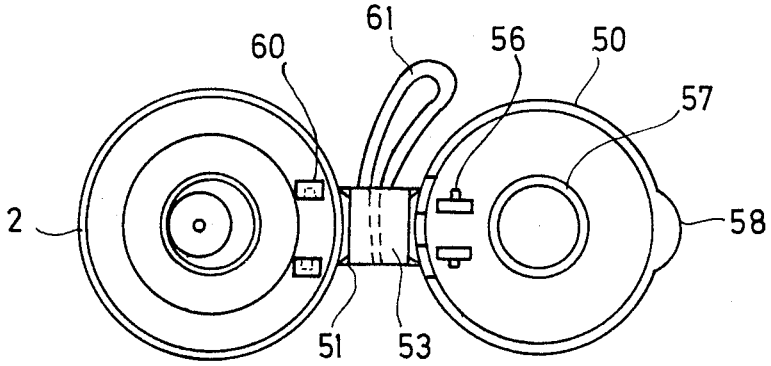
FIG. 8 is a top view of the device fitted with said protective cap in which this latter is in the fully open position, before assembling it on the cover.

In an industrial embodiment which will now be described with reference to FIGS. 7 and 8, the spray-discharge device in accordance with the invention is provided with a protective cap 50 forming a tamper-proof sealing capsule. This protective cap closes against the container cover 2, entirely covers this latter and is capable of pivotal displacement about a hinge axis formed by two pivots 56 carried by projecting lugs provided on the underface of the protective cap 50. Said pivots are housed within cavities 60 formed in corresponding lugs provided on the top face of the container cover 2.

In a position diametrically opposite to the hinge axis, the protective cap 50 has a small tongue 58 which serves to lift the cap with a finger. Said protective cap also has a cylindrical skirt 57, the lower edge of which is adapted to engage by snap-fastening on an annular bead 59 formed on the central portion of the container cover 2.

In addition, the container cover 2 and the protective cap 50 are initially joined together at their edges in proximity to the hinge axis by means of strips 51 which can readily be fractured at the four corners of a flexible plate 53 which is thus folded in two at the center until the spray dispenser is used for the first time. The low strength of the strips 51 makes it possible to tear-off the plate 53 when the user lifts the protective cap 50 for the first time by exerting a light force on each side of the hinge. It is also possible to remove the plate 53 beforehand by pulling on a loop 61 specially provided for this purpose.

It will clearly be understood that the invention is not limited in any respect to the particular features specified in the foregoing or to the details of the particular embodiments which have been chosen in order to illustrate the invention. Without thereby departing either from the scope or the spirit of this invention, it remains possible to consider all kinds of variants and to make any number of modifications in the particular forms of construction hereinabove described by way of example and in their constituent elements. Thus the invention includes all technical equivalents of the means hereinabove described as well as combinations of such means.

What is claimed is:

1. A spray-discharge device for a deformable container in which a pressure is developed for expelling a liquid from the container via an eductor tube and in which a partial vacuum is created in order to suck air into said container, said container having an orifice formed through a rigid cover which closes the container, wherein said device comprises said cover having an internal face fixedly positioned relative to the container, a valve unit which is capable of moving axially within the container with respect to the container cover between a spray-discharge position and an air-suction position, said valve unit having a first portion for shutting-off the eductor tube in its air-suction position and having a hollow valve-cap portion, said hollow valve-cap portion defining a first flow path from said eductor tube through an interior space of said hollow valve-cap portion and defining a second flow path between said rigid cover and an outer surface of said hollow valve-cap portion, said second flow path communicating with said first flow path through an opening in said hollow valve-cap portion, said orifice in said rigid cover being spaced laterally of said opening in said hollow valve-cap.

2. A device according to claim 1, wherein said valve-unit first portion comprises an axial valve stem formed in one piece with the valve-cap portion.

3. A device according to claim 1, wherein said valve unit cooperates with said internal face of said rigid cover to form a means for producing vortical flow motion when the valve unit is in the spray-discharge position, said vortical flow motion producing means comprising ducts disposed in a radiating pattern with respect to said orifice and formed in at least one of the external face of the valve-cap portion and the internal face of the container cover.

4. A device according to claim 3, wherein the first flow path communicates with the second flow path through a plurality of openings in said hollow valve cap portion, said openings being positioned at an end of said ducts which is opposite to said container-cover orifice.

5. A device according to claim 1, wherein the valve unit comprises wings for guiding said unit as it moves with respect to the container cover.

6. A device according to claim 5, wherein the guide wings aforesaid are slidably engaged within grooves formed longitudinally within a skirt which is integral with the container cover.

7. A device according to claim 1, wherein the valve cap portion has an external face which bears against the internal face of the container cover, and the bearing faces have a surface area which is substantially larger than the cross-sectional area of said orifice of the container cover.

8. A device according to claim 7, wherein said bearing faces have a substantially circular contour and are oriented obliquely with respect to the axis of the device, said discharge orifice being for an inclined spray.

9. A device according to claim 1, wherein said first portion of said valve unit is movably mounted with the valve-cap portion.

10. A device according to claim 9, wherein said device comprises a tube providing a connection with the eductor tube and forming a seat for said first portion of said valve unit.

11. A device according to claim 1, wherein said device comprises a cup which forms a connection between the eductor tube and the container cover, said cup being provided with means for cooperating with said first portion of said valve unit and said cup having at least one orifice for the flow of air from said container through said cup into said second flow path.

12. A device according to claim 11, wherein the aforesaid cup is attached by snap-action engagement on the container cover.

13. A device according to claim 1, wherein said cup has a central duct for guiding the flow of liquid toward said opening of said valve cap portion in the spray-discharge position of the valve unit.

14. A device according to claim 3, wherein the aforesaid central duct of the cup comprises an internal lip which forms a valve seat for the first portion of the valve unit.

15. A device according to claim 13, wherein the valve unit comprises an annular part or portion forming an extension of said valve-cap portion at the periphery around the central duct of said cup, the opening aforesaid of said valve cap portion being adapted to open into the interior of said annular part.

16. A device according to claim 13, wherein the central duct of the cup comprises an internal lip forming a seat for said first portion of said valve unit.

17. A spray-discharge device for a deformable container in which a pressure is developed for expelling a liquid from the container via an eductor tube and in which a partial vacuum is created in order to suck air into said container, said container having an orifice formed through a rigid cover which closes the container, wherein said device comprises said cover having an internal face fixedly positioned relative to the container, a valve unit which is capable of moving axially within the container with respect to the container cover between a spray-discharge position and an air-suction position, said valve unit having a first portion for shutting-off the eductor tube in its air-suction position and having a valve-cap portion, said valve cap portion defining a liquid flow channel extending from said eductor tube to a position spaced from said orifice, and an air flow channel which extends from a position outside of said eductor tube to said position spaced from said orifice, said liquid flow channel and said air flow channel meeting at an acute angle at said position spaced from said orifice, and a mixture channel in alignment with said air channel and extending from said position spaced from said orifice to said orifice, said mixture channel extending laterally from the liquid flow channel at said spaced positions.

* * * * *